United States Patent [19]

Iwasaki et al.

[11] Patent Number: 4,731,355

[45] Date of Patent: Mar. 15, 1988

[54] IMAGE-RECEIVING SHEET FOR THERMAL DYE-TRANSFER RECORDING

[75] Inventors: Hiroshi Iwasaki; Kazuo Watanabe, both of Hyogo, Japan

[73] Assignee: Kanzaki Paper Mfg. Co., Ltd., Tokyo, Japan

[21] Appl. No.: 915,902

[22] Filed: Oct. 6, 1986

Related U.S. Application Data

[63] Continuation of Ser. No. 748,861, Jun. 26, 1985, abandoned.

[30] Foreign Application Priority Data

Jun. 27, 1984 [JP] Japan ..... 59-133517

[51] Int. Cl.[4] ..... B41M 5/26

[52] U.S. Cl. ..... 503/227; 8/471; 428/195; 428/207; 428/340; 428/526; 428/913; 428/914

[58] Field of Search ..... 428/530, 526, 914, 913, 428/195, 207, 219, 340; 8/470, 471; 346/227; 503/227

[56] References Cited

U.S. PATENT DOCUMENTS

| | | | |
|---|---|---|---|
| 4,285,989 | 8/1981 | Wilkinson et al. | 428/530 X |
| 4,490,434 | 12/1984 | Oshima et al. | 8/471 X |
| 4,490,435 | 12/1984 | Oshima et al. | 428/530 X |
| 4,626,256 | 12/1986 | Kawasaki et al. | 428/195 X |
| 4,650,494 | 3/1987 | Katsukake et al. | 428/195 X |

FOREIGN PATENT DOCUMENTS

| | | | |
|---|---|---|---|
| 0141678 | 5/1985 | European Pat. Off. | 428/914 |

*Primary Examiner*—Thomas J. Herbert

*Attorney, Agent, or Firm*—Finnegan, Henderson, Farabow, Garrett and Dunner

[57] ABSTRACT

A thermal dye-transfer recording, image-receiving sheet, comprising a support having thereon an image-receiving layer containing a butyral resin for receiving a transferred image from a coloring material-transferring sheet, is disclosed. In this image-receiving sheet, sharp recorded images can be obtained, and the images exhibit excellent storage stability and abrasion resistance.

20 Claims, No Drawings

IMAGE-RECEIVING SHEET FOR THERMAL DYE-TRANSFER RECORDING

This application is a continuation of application Ser. No. 748,861, filed June 26, 1985, now abandoned.

FIELD OF THE INVENTION

The present invention relates to an image-receiving sheet for thermal dye-transfer recording, and more particularly to an improvement in an image-receiving sheet for thermal dye-transfer recording utilizing heat-sublimable dyes. According to the present invention, thermal dye-transfer recorded images having greatly improved storage stability and abrasion resistance can be obtained.

BACKGROUND OF THE INVENTION

A thermal recording system for obtaining recorded images simultaneously with the application of input signals is widely used in facsimile machines, computer terminal printers, and printers for measuring equipment because the apparatus used in a thermal recording system is relatively simple and inexpensive, and it is of low noise.

The recording medium most commonly used in such a thermal recording system is a so-called color formation-type heat-sensitive recording paper, which is provided with a recording layer which undergoes physical and chemical changes on heating to cause color formation. This recording medium, however, has several disadvantages. One of the disadvantages is that the recording medium is liable to cause unnecessary color formation during the production or storage thereof. Another disadvantage is that the storage stability of images recorded on this medium is poor. For example, images so produced exhibit a fading phenomenon when brought into contact with organic solvents or chemicals.

In order to overcome the above problems, a recording system has been proposed in which a recording medium utilizing a coloring material which is colored itself is used in place of the above color formation-type heat-sensitive recording paper. For example, Japanese Patent Application (OPI) No. 15446/76 (the term "OPI" as used herein refers to a "published unexamined Japanese patent application") discloses a recording system in which a substrate, such as paper and a polymer film, coated with a coloring material which is solid or semi-solid at room temperature is superposed on a recording paper (image-receiving paper) in such a manner that the coloring material coated on the substrate comes into contact with the recording paper. Then the coloring material is selectively transferred to the recording paper by heating the substrate with a thermal recording head, thereby recording a desired image.

In this recording system, the coloring material on the substrate is melted, evaporated, and sublimated by the application of heat. Then it is transferred to the recording paper and fixed thereon by the action of sticking, adsorption, and dye-fixing, to thereby form a recorded image. One of the characteristic features of this recording system is that plain paper (non-coated paper) can be used as the recording paper. However, when plain paper is used as the recording paper, the dye-fixing, in particular, is difficult to accomplish. As a result, not only is the resulting recorded image low in color density, but a serious fading phenomenon also occurs over a lapse of time.

SUMMARY OF THE INVENTION

An object of the present invention is to provide an improved image-receiving sheet for use in the thermal dye-transfer recording in which a coloring material, particularly a heat-sublimable dye, is thermally-transferred.

Another object of the present invention is to provide an image-receiving sheet capable of providing recorded images which are very sharp, high in color density, and greatly improved in storage stability and abrasion resistance.

To achieve the objects and in accordance with the purposes of the invention, as embodied and broadly described herein, the thermal dye-tansfer recording image receiving sheet of this invention comprises a support having thereon an image-receiving layer containing a butyral resin for receiving a transferred image from a coloring material-transferring sheet.

DETAILED DESCRIPTION OF THE INVENTION

The butyral resin which is contained in the image-receiving layer of the image-receiving sheet of the present invention can be generally prepared by reacting polyvinyl alcohol and butyl aldehyde and can be obtained in the form of a vinyl butyral/vinyl alcohol copolymer by appropriately controlling the degree of substitution. It is preferred that the degree of butyralization be at least 50 mol%. In particular, a butyral resin having a degree of butyralization of from 55 to 75 mol% is most preferred because it has excellent dye-fixing properties and thus, provides an image-receiving layer capable of forming a recorded image having excellent storage stability.

An unsaponified vinyl acetate group resulting from the starting polyvinyl alcohol may adversely affect the heat resistance of the image-receiving layer, and therefore, it is desirable that the unsaponified vinyl acetate group content in the butyral resin be controlled to 20 mol% or less, with the range of 10 mol% or less being more preferred.

The butyral resin is generally dissolved in a suitable organic solvent such as benzene, toluene, xylene, ethyl acetate, acetone, and methyl ethyl ketone, to be adjusted to a suitable concentration and viscosity depending on the type of a coating head, and then coated on a support by means of coating equipment such as, for example, a blade coater, an air knife coater, a bar coater, a roll coater, a gravure coater, or a curtain coater, and then dried.

In preparing the coating composition, various additives can be added, if desired. For example, vinyl polymers such as polystyrenes and polyacrylates and condensation polymers such as polyesters, polycarbonates, and polysulfones can be added for the purpose of improving the physical properties of the coating composition and the recording characteristics. In addition, for the purpose of improving the physical properties of the surface of the image-receiving layer, such as improving the writing properties of the image-receiving sheet, inorganic or organic pigments such as natural ground calcium carbonate, precipitated calcium carbonate, talc, clay, natural or synthetic silicic acids, titanium oxide, aluminum hydroxide, zinc oxide, or a powdered urea/- formaldehyde resin, and various auxiliary agents can be added.

Since the butyral resin used in the present invention contains hydroxyl groups in the molecule, the physical properties of the image-receiving layer can be improved upon heating. Combining the butyral resin with a cross-linking agent gives rise to a marked improvement in the heat resistance of the image-receiving layer. Suitable examples of cross-linking agents which can be used include polyfunctional cross-linking agents such as polyisocyanates, epoxy compounds, and polymethylols; and polyfunctional monomers having two or more unsaturated groups in the molecule, such as polyfunctional polyesters, polyfunctional epoxy acrylates, polyfunctional ether acrylates, and polyfunctional polyester acrylates. The amount of the cross-linking agent added is generally 50% by weight or less based on the butyral resin. If desired, catalysts can be used in combination with the cross-linking agent, or the cross-linking can be attained by heating or irradiating with actinic radiation such as ultraviolet light, electron beams, or X-rays.

The amount of the butyral resin coated on the support can be varied widely, depending on the purpose for which the image-receiving sheet is to be used. In general, the butyral resin is coated in an amount (on a dry weight basis) of from 2 to 15 g per square meter of the support.

As the support, plain paper, synthetic paper, synthetic resin films, and so on can be used. In general, the preferred support is plain paper because it exhibits excellent thermal properties. Examples of useful types of plain paper include paper produced by adding to the cellulose pulp, which is the main component, certain additives, such as paper strengthening agents, sizing agents, fixing agents, and inorgaic or organic fillers followed by the usual paper-making procedures; and paper produced by size pressing with oxidized starch or providing a pre-coat layer made mainly of a pigment, such as clay to thereby improve the physical properties of the surface thereof.

The image-receiving sheet for thermal dye-transfer recording to the present invention exhibits excellent performance, particularly when used in combination with a coloring material-transferring sheet containing a heat-sublimable dye. That is, in this case, the image-receiving sheet produces recorded images which are sharp, high in color density, and greatly improved in storage stability and abrasion resistance.

Although exact reasons why the above excellent effects can be obtained are not always clear, it is considered that, in view of the fact that the image-receiving sheet of the present invention is excellent in dye-receiving ability and gives sharp recorded images particularly resistant to light, during the thermal-transfer, the dye is probably absorbed in the butyral resin present in the image-receiving layer to exhibit its dissolved color. At the same time, it is presumably diffused in molecular form and thus stabilized in the butyral resin matrix. This theory is supported by the fact that when the dye is not sufficiently diffused because of insufficient heat absorption during the recording so that the dissolved color is not satisfactorily exhibited, a recorded image having greatly improved storage stability can still be obtained by subjecting the image-receiving sheet to a post-heat treatment, for example, by pressing it against a hot plate or irradiating it with a flash lamp.

The term "heat-sublimable dye" as referred to herein means a dye which does not transfer a coloring material when contacted with the image-receiving sheet under the usual handling conditions but which, when heated to 60° C. or more, tranfers the coloring material as the result of melting, evaporation, and sublimation. The heat-sublimable dye is selected appropriately from various dyes such as disperse dyes represented by azo-, nitro-, anthraquinone-, and quinoline-based dyes, basic dyes represented by triphenylmethane- and fluoran-based dyes, and oil-soluble dyes.

The image-receiving sheet of the present invention is useful in the thermal recording system including not only the contact heating type, in which the sheet is contact heated by the use of a hot plate or the thermal head of a thermal printing unit, but also the non-contact heating type, in which the sheet is irradiated with rays such as infrared light, YAG laser, carbon dioxide laser, and the like.

The present invention is described in greater detail with reference to the following examples although it is not limited thereto. All parts and percents (%) are by weight unless otherwise indicated.

EXAMPLE 1

Ten parts of a butyral resin (degree of butyralization: 67 mol%, residual acetyl group: 5 mol%, average degree of polymerization: 500) was dissolved in a mixed solvent of 40 parts of toluene and 40 parts of methyl ethyl ketone, and 10 parts of surface-treated calcium carbonate (trade name: Lyton A, produced by Bihoku Funka K.K.) was dispersed in the above-prepared solution to prepare a coating composition. This coating composition was at a coating weight (dry basis) of 10 $g/m^2$ coated on a plain paper having a basis weight of 60 $g/m^2$ and then dried. The coated paper was subjected to a super calender treatment at a pressure of 150 kg/cm to prepare an image-receiving sheet for thermal dye-transfer recording.

COMPARATIVE EXAMPLE 1

An image-receiving sheet was prepared in the same manner as in Example 1 except that the butyral resin was replaced by a saturated polyester resin (trade name: Vylon 200, produced by Toyobo Co., Ltd.).

COMPARATIVE EXAMPLE 2

The same plain paper (basis weight: 60 $g/m^2$) as used in Example 1 was used as an image-receiving sheet without application of any coating.

EXAMPLES 2 TO 7

Image-receiving sheets were prepared in the same manner as in Example 1 except that butyral resins and pigments as shown in Table 1 were used.

TABLE 1

| Example No. | Butyral Resin Type: Degree of Butyralization (mol %) | Residual Acetyl Group (mol %) | Average Degree of Polymerization | Amount (parts) | Pigment: Type | Amount (parts) |
|---|---|---|---|---|---|---|
| 2 | 60 | 3 | 250 | 5 | special clacined kaolin clay(1) | 15 |
| 3 | 63 | 6 | 500 | 12 | calcined kaolin clay(2) | 8 |
| 4 | 65 | 2 | 500 | 10 | super-finely divided amorphous silica(3) | 10 |
| 5 | 65 | 3 | 2,000 | 10 | super-finely divided silicic acid(4) | 10 |
| 6 | 68 | 3 | 1,000 | 10 | titanium oxide | 10 |
| 7 | 70 | 1 | 1,000 | 15 | super-finely divided hydrated silicic acid(5) | 5 |

Note:
(1)Trade name: Tysin; produced by Burgess Pigment Co.
(2)Trade name: Burgess KE; produced by Burgess Pigment Co.
(3)Trade name: Finesil X-37; produced by Tokuyama Soda Co., Ltd.
(4)Trade name: Silton R-2; produced by Mizusawa Industrial Chemicals, Ltd.
(5)Trade name: Nipsil E-220A; produced by Nippon Silica Industrial Corporation The thus prepared nine image-receiving sheets were subjected to the quality test described below.

First, three types of coloring material-transferring sheets were prepared as follows: One part of each of three heat-sublimable dyes (Disperse Yellow 3, Disperse Red 60, and Solvent Blue 36), 1.5 parts of hydroxypropyl cellulose, and 15 parts of isopropyl alcohol were mixed, pulverized, and dispersed in a ball mill, to prepare three kinds of dye inks. Each dye ink was gravure printed at a coating weight (dry basis) of 1.8 g/m$^2$ on a 12 μm thick condensor paper to prepare a coloring material-transferring sheet.

The coloring material-transferring sheet was superposed on the image-receiving sheet in such a manner that the coated sides of the sheets came in contact with each other. Thereafter, heat was applied from the back side of the coloring material-transferring sheet by the use of a thermal head (16 V, 4 ms) to obtain a thermal dye-transferred recorded image on the image-receiving layer of the image-receiving sheet. Then, the density of each color of yellow, red, and blue was measured with a Macbeth color densitometer. The results are shown in Table 2.

Further, the heat resistance of the recorded image was evaluated by heating the recorded image at 50° C. for 5 hours. The light resistance was evaluated by exposing the recorded image to a xenon lamp (150 W) for 3 hours. The changes in the density and resolution properties of the recorded images were evaluated based on the criterion shown below.

A: No change.
B: Slight change, but suitable for practical use.
C: Serious change and unsuitable for practical use.

The results are shown in Table 2.

TABLE 2

| | Image Density: Yellow | Red | Blue | Heat Resistance: Density | Resolution Properties | Light Resistance Density |
|---|---|---|---|---|---|---|
| Example 1 | 1.21 | 1.05 | 1.11 | A | B | A |
| Comparative Example 1 | 1.11 | 1.07 | 1.10 | A | B | B |
| Com- | 0.56 | 0.54 | 0.65 | C | C | C |

TABLE 2-continued

| | Image Density: Yellow | Red | Blue | Heat Resistance: Density | Resolution Properties | Light Resistance Density |
|---|---|---|---|---|---|---|
| parative Example 2 | | | | | | |
| Example 2 | 1.21 | 1.07 | 1.14 | A | B | A |
| Example 3 | 1.27 | 1.05 | 1.1 | A | B | A |
| Example 4 | 1.30 | 1.10 | 1.21 | A | A | A |
| Example 5 | 1.31 | 1.10 | 1.20 | A | A | A |
| Example 6 | 1.29 | 1.12 | 1.20 | A | B | A |
| Example 7 | 1.20 | 1.09 | 1.15 | A | B | A |

It can be seen from Table 2 that in all the image-receiving sheets of the present invention, sharp recorded images can be obtained and, further, the recorded images exhibit excellent storage stability.

While the invention has been described in detail and with reference to specific embodiments thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A recording system comprising:

a. a coloring material-transferring sheet containing a heat-sublimable dye; and b. a thermal dye-transfer recording, a heat-sublimable dye-receiving sheet comprising a support having thereon a heat-sublimable dye-receiving layer containing a butyral resin for receiving heat-sublimable dye from the coloring material-transferring sheet.

2. A recording system as claimed in claim 1, wherein said butyral resin is coated on said support in an amount of from 2 to 15 g per square meter of said support on a dry weight basis.

3. A recording system as claimed in claim 1, wherein said butyral resin is a reaction product of polyvinyl alcohol and butyl aldehyde.

4. A recording system as claimed in claim 3, wherein said butyral resin has a degree of butyralization of at least 50 mol%.

5. A recording system as claimed in claim 4, wherein said butyral resin has a degree of butyralization of from 55 to 75 mol%.

6. A recording system as claimed in claim 3, wherein the unsaponified vinyl acetate group content in said butyral resin resulting from the starting polyvinyl alcohol is controlled to 20 mol% or less.

7. A recording system as claimed in claim 6, wherein the unsaponified vinyl acetate group content in said butyral resin resulting from the starting polyvinyl alcohol is controlled to 10 mol% or less.

8. A recording system as claimed in claim 1, wherein said butyral resin is used in combination with a cross-linking agent.

9. A recording system as claimed in claim 8, wherein said cross-linking agent is used in an amount of 50% by weight or less based on said butyral resin.

10. A method for obtaining a thermal dye-transferred recorded image comprising the steps of:

a. superimposing (1) a coloring material-transferring sheet, comprising a substrate having coated thereon a coloring material, over (2) a thermal dye-transfer recording, heat-sublimable dye-receiving sheet, comprising a support having thereon a heat-sublimable dye-receiving layer containing a butyral resin, in such a manner that the coloring material coated on the substrate comes into contact with the heat-sublimable dye-receiving layer; and b. heating the substrate of the coloring material transferring sheet to selectively transfer at least a portion of the coloring material to the heat-sublimable dye-receiving layer.

11. A method as claimed in claim 10, wherein the coloring material is colored itself and is solid or semi-solid at room temperature.

12. A method as claimed in claim 10, wherein a thermal recording head is used to heat the substrate of the coloring material transferring sheet to selectively transfer at least a portion of the coloring material to the heat-sublimable dye-receiving layer.

13. A method as claimed in claim 10, wherein the butyral resin is coated on the support in an amount of from 2 to 15 g per square meter of the support on a dry weight basis.

14. A method as claimed in claim 10, wherein the butyral resin is a reaction product of polyvinyl alcohol and butyl aldehyde.

15. A method as claimed in claim 14, wherein the butyral resin has a degree of butyralization of at least 50 mol%.

16. A method as claimed in claim 14, wherein the butyral resin has a degree of butyralization of from 55 to 75 mol%.

17. A method as claimed in claim 14, wherein the unsaponified vinyl acetate group content in the butyral resin resulting from the starting polyvinyl alcohol is controlled to 20 mol% or less.

18. A method as claimed in claim 17, wherein the unsaponified vinyl acetate group content in the butyral resin resulting from the starting polyvinyl alcohol is controlled to 10 mol% or less.

19. A method as claimed in claim 10, wherein the butyral resin is used in combination with a cross-linking agent.

20. A method as claimed in claim 18, wherein the cross-linking agent is used in an amount of 50% by weight or less based on the butyral resin.

* * * * *